US006635005B1

(12) United States Patent
Duhamel et al.

(10) Patent No.: US 6,635,005 B1
(45) Date of Patent: Oct. 21, 2003

(54) COPY-GUIDING DEVICE HAVING A VARIABLE GEOMETRY

(75) Inventors: Claude Duhamel, Mogneville (FR); Thierra Melon, Breuil le Vert (FR)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/361,613

(22) Filed: Jul. 27, 1999

(30) Foreign Application Priority Data

Jul. 27, 1998 (DE) ..... 198 33 578

(51) Int. Cl.[7] ..... B31F 1/00
(52) U.S. Cl. ..... 493/417; 493/424; 493/476
(58) Field of Search ..... 493/475, 476, 493/417, 424, 225, 434, 442

(56) References Cited

U.S. PATENT DOCUMENTS 4,099,710 A * 7/1978 Boyer et al.
4,521,007 A * 6/1985 Darda
5,065,993 A * 11/1991 Reponty
5,226,871 A * 7/1993 Skipor
5,547,452 A 8/1996 Kepert et al.
5,807,227 A * 9/1998 Field
5,987,860 A * 11/1999 Yang

FOREIGN PATENT DOCUMENTS

JP 02 221 063 9/1990
JP 10 129 929 5/1998

* cited by examiner

*Primary Examiner*—Eugene Kim
(74) *Attorney, Agent, or Firm*—Laurence A. Green; Werner H. Stemer; Gregory L. Maybac

(57) ABSTRACT

A guiding device for copies in a folder of a rotary printing machine includes a guiding material engageable with copies projecting into an outlet wedge formed between copy-guiding cylinders, the guiding material forming a surface of the guiding device facing towards the copies, the surface having a geometry that is changeable, and copy-guiding cylinders in combination with the guiding device, and a folder with copy-guiding cylinders and the guiding device, as well as a guiding device assembly including the guiding device.

24 Claims, 4 Drawing Sheets

COPY-GUIDING DEVICE HAVING A VARIABLE GEOMETRY

BACKGROUND OF THE INVENTION

Field of the Invention

The invention relates to a copy-guiding or directing device having a variable geometry for use, for example, in critical copy-guiding regions on copy-guiding cylinders in folders; and copy-guiding cylinders in combination with the copy-guiding device; a folder with copy-guiding cylinders and the guiding device; as well as a guiding device assembly including the guiding device.

The published German Patent Document DE 35 12 308 A1 discloses a folder having a jaw cylinder and a tucker-blade cylinder cooperating with the jaw cylinder, provided with a guiding device disposed in the direction of rotation of the cylinders, which cooperate during a folding operation. The guiding device is located behind or downline of the folding location, in an outlet wedge formed between the two cylinders, and extends over the entire cylinder length. During the folding operation, it is intended, on the one hand, that the copy regions which are drawn off from the circumferential surface of the cylinders be treated with care and, on the other hand, that the guiding device per se not be subjected to excessive loading. For this purpose, the guiding device is provided with a central part having a somewhat cylindrical jacket surface and mounted so as to be freely rotatable about a cylinder-parallel axis. Laterally adjoining the central part, in the jacket surface thereof, are stationary connecting elements. This construction does not provide for a change in the surface contour or surface geometry of the guiding device.

U.S. Pat. No. 4,521,007 relates to a braking-brush device in a folder of a rotary printing machine. Braking brushes are provided for stretching, in the longitudinal direction thereof, web sections which are transported in a conveying direction. The braking brushes are arranged so that they fit closely or snugly against the curvature of the cylinder surface and are distributed over the entire cylinder width. Furthermore, a transverse support and an adjusting spindle are disposed so that they extend parallel to the longitudinal axis of the cylinder, the braking brushes being held by lower ends thereof on the adjusting spindle, and by upper ends thereof on the transverse supports, the respective transverse supports being held at the ends thereof by levers. Through the intermediary of the levers, the respective transverse supports can be engaged or brought into contact, to a greater or lesser extent, with the web sections unrolling on or off-running from the cylinder.

U.S. Pat. No. 5,226,871 discloses a guiding device for guiding copies on a cylinder. In a folder having a jaw cylinder, a web length is cross cut from the web and folded. The cylinder has a guiding device assigned thereto that includes a non-concentric guide part with a convexly curved section and a further convexly curved guide part joined to the non-concentric guide part. The curved guide surface that is produced by the mutual joining of the two guide parts corresponds to a natural conveying path of the folding products and, with little adverse effect to the product run, reduces the occurrence of dog ears and the like.

The published European patent Document EP 0 220 644 A2 relates to a suction device in a combination folder. Located beneath an outlet wedge defined between two cooperating folding cylinders is a suction device arrangement, with the aid of which it is possible to reduce the consequences of a whiplash effect occurring when the product-conveying direction is reversed. The suction device includes a freely rotatably mounted suction roller and two stationary guide parts arranged adjacent thereto.

The published German Patent Document DE 197 08 213 A1 relates to a method and a device for guiding products in a fold-forming region of a folder. The folder includes a first cylinder for transporting a product, and a folding cylinder that is in rotary connection, in a gap, with the first cylinder. Assigned to a transfer region between the surfaces of the first cylinder and the folding cylinder is a product-guiding device that includes a smoothing element having different sections of product contact elements which are arranged so that they extend angularly away from one another in opposite directions. In this device, also, the geometry of the product-guiding device that projects into the cylinder wedge is fixedly prescribed.

SUMMARY OF THE INVENTION

With regard to the prior state of the art described herein, it is an object of the invention to provide a copy-guiding device having a variable geometry and, more specifically, to optimize a guiding device for flat products so that the guiding device may be adapted to flat products with different material properties.

With the foregoing and other objects in view, there is provided, in accordance with one aspect of the invention, a guiding device for copies in a folder of a rotary printing machine, comprising a guiding material engageable with copies projecting into an outlet wedge formed between copy-guiding cylinders, the guiding material forming a surface of the guiding device facing towards the copies, the surface having a geometry that is changeable.

In accordance with another feature of the invention, the guiding device has at least one guide body.

In accordance with a further feature of the invention, the guiding device is swivellable relative to the outlet wedge formed between the copy-guiding cylinders.

In accordance with an added aspect of the invention, there is provided a guiding device assembly including the guiding device having at least one of the foregoing features, and a shaft about which the guiding device is swivellable.

In accordance with yet another aspect of the invention, there is provided a guiding device assembly including the guiding device having at least one of the foregoing features, and an adjusting cylinder for swivelling the guiding device.

In accordance with yet a further feature of the invention, the at least one guide body has a structure for holding the guiding material.

In accordance with yet an added feature of the invention, the guiding material is relatively movable in the structure of the at least one guide body.

In accordance with yet an additional feature of the invention, the guiding material is movable relative to an abutment surface formed on the at least one guide body.

In accordance with still another feature of the invention, the guiding device includes an extensible adjusting element, the guiding material being fastened centrally on the extensible adjusting element.

In accordance with still a further feature of the invention, the at least one guide body has an actuatable adjusting element that is retractable and extensible.

In accordance with still an added feature of the invention, the guiding device includes a plurality of the guide bodies, and a common drive for actuating the adjusting elements of the guide bodies.

In accordance with still an additional feature of the invention, the adjusting elements are adjustable by the drive relative to the guide bodies.

In accordance with another feature of the invention, the guiding device includes a plurality of the guide bodies arranged side by side so that they extend over the width of the copy-guiding cylinders.

In accordance with a further feature of the invention, the guiding device includes a fastener for fastening the guiding material on the adjusting element, and the fastener is set back behind a surface of the guiding material that faces towards the copies.

In accordance with an additional aspect of the invention, copy-guiding cylinders are provided in combination with a guiding device for copies in a folder of a rotary printing machine, comprising a guiding material engageable with copies projecting into an outlet wedge formed between the copy-guiding cylinders, the guiding material forming a surface of the guiding device facing towards the copies, the surface having a geometry that is changeable.

In accordance with a concomitant feature of the invention, there are provided a folder with copy-guiding cylinders and a guiding device for copies, comprising a guiding material engageable with copies projecting into an outlet wedge formed between the copy-guiding cylinders, the guiding material forming a surface of the guiding device facing towards the copies, the surface having a geometry that is changeable.

The advantages which are associated with the foregoing realizations of the invention reside in the fact that it is possible to reduce in a manner specific to the relevant printing material the accelerations which occur during the cross-folding operation when the conveying direction of the folding products is changed. The adaptation or accommodation of the geometry of that surface of the guiding device which faces towards the copies allows the guiding material to penetrate more or less deeply into the outlet wedge between the copy-guiding cylinders. It is thus possible for the corners of the end regions of the copies, in the case of low grammage, to be prevented effectively from folding over or "dog-earing".

In a further configuration of the subject matter upon which the invention is based, the guiding device comprises at least one guide body. The guide bodies of the guiding device may be located side by side so that they cover the entire or just part of the width of the copy-guiding cylinders in the region in front of the outlet wedge. The guiding device can preferably be swivelled or pivoted relative to the outlet wedge between the copy-guiding cylinders and may be received or held on a shaft that passes through all the guide bodies of the guiding device. The guiding device is preferably swivelled or pivoted by an adjusting cylinder that may be supported on the housing of the folder.

The individual guide bodies of the guiding device are provided with a holder or receiver for the guiding material. The guiding material may be mounted in the holder or receiver so that it is movable relative to the latter in order to follow changes in geometry when the surface contour of the guiding device is changed. In this regard, the guiding material is also displaced relative to an abutment surface of the guide body. The guiding material is fastened on an adjusting element that brings about the respective changes in geometry to the guide bodies of the guiding device. The adjusting element may be a hammerhead-like, but rounded component, of which the outer surface, which acts upon the guiding material, is rounded, the adjusting element being so configured that it is both retractable into the guide body and extensible out of the guide body again.

The adjusting elements, respectively, which cause the changes in geometry to the guide bodies, are actuatable or operatable via a common drive that actuates the adjusting elements, which may be received on adjusting spindles, relative to the guide bodies. The guide bodies may be located side by side; however, it is also possible for them to extend over the width of the copy-guiding cylinders at a distance from one another, forming a gap therebetween in the process.

The guiding material, the surface of which is directed towards the copy-conveying route, is mounted on the adjusting element so that it is set back behind that surface of the guiding material that faces towards the copies.

The guiding device according to the invention may be received or held on the copy-guiding cylinders, which for their part may be arranged in the cylinder part of a folder arranged downline of a rotary printing machine.

Other features which are considered as characteristic for the invention are set forth in the appended claims.

Although the invention is illustrated and described herein as embodied in a copy-guiding device having a variable geometry, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
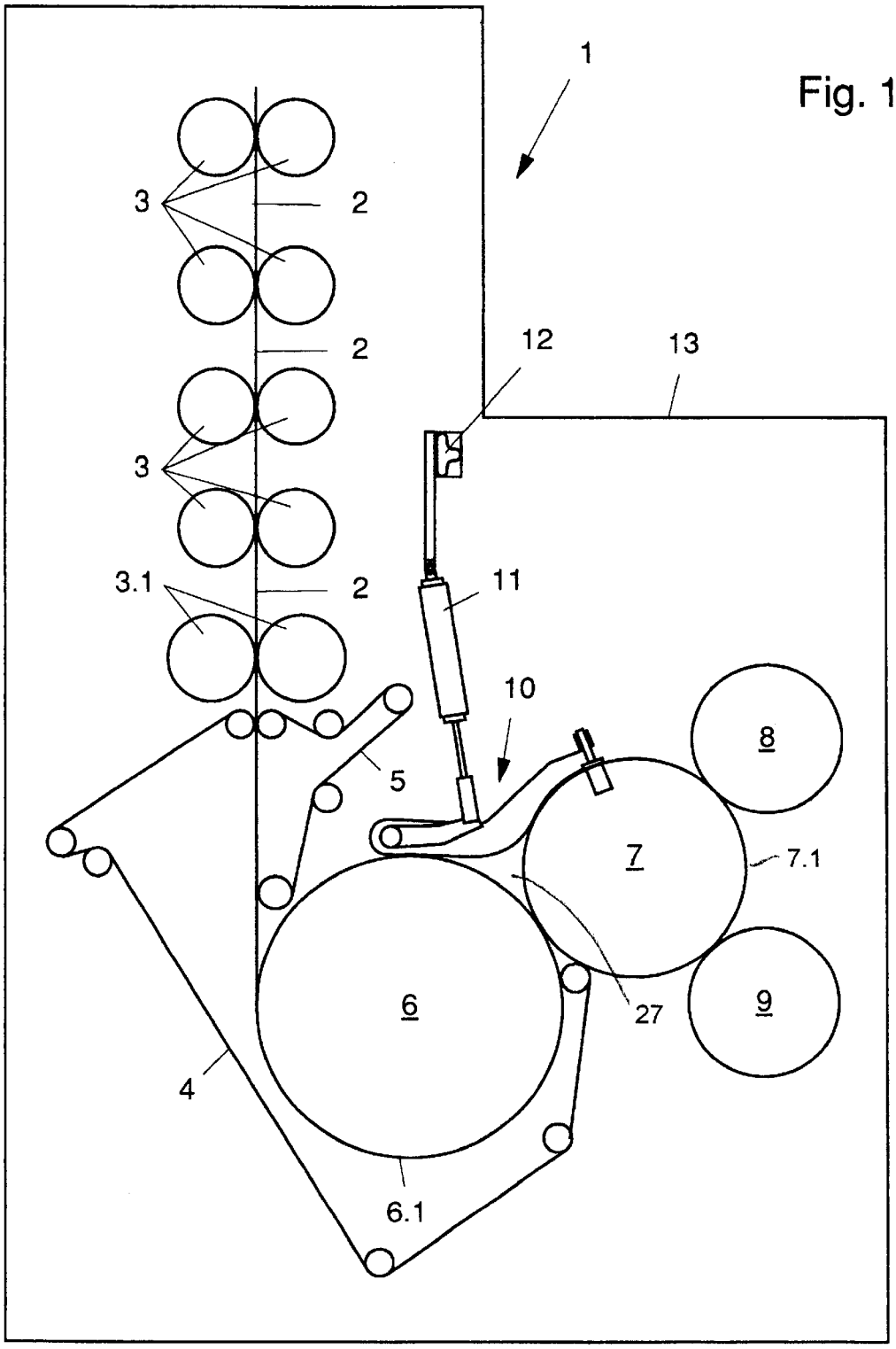
FIG. 1 is a diagrammatic side elevational view of a folder having a guiding device according to the invention located above an outlet wedge between two cylinders.

Referring now to the drawings and, first, particularly to FIG. 1 thereof, there is shown therein, in a diagrammatic side elevational view, a folder 1 having a guiding device assembly including a guiding device 10 according to the invention that is disposed above an outlet wedge 27 (note FIG. 2) located between two copy-guiding cylinders 6 and 7.

A material web 2 conveyed by a plurality of cooperating draw-roller pairs 3, runs into a cylinder part of the folder 1. A cutting-cylinder pair 3.1 severs copies from the material web 2, and these copies run into transporting belts 4 and 5 by which they are transported to the copy-processing cylinders 6 and 7. The first copy-guiding cylinder 6 may be, for example, a tucker-blade cylinder that cooperates with a second copy-guiding cylinder 7. The second copy-guiding cylinder 7 is constructed, for example, as a jaw cylinder. From the first copy-guiding cylinder 6, the copies are driven into the folding jaws of the second copy-guiding cylinder 7 via cross-folding elements such as tucker blades. Formed between the surfaces 6.1 and 7.1 of the respective copy-guiding cylinders 6 and 7 is an outlet wedge 27 that is illustrated in greater detail in FIGS. 2, 3 and 4. Located above the wedge region between the copy-guiding cylinders 6 and 7 is the guiding device assembly including the guiding device 10 that is swivellable upwardly and downwardly, as viewed in FIG. 1, for example, by an adjusting or adjusting cylinder 11 mounted in an abutment 12 of a housing 13 of the folder 1.

In the interest of completeness, it should be noted that there are provided behind the second copy-guiding cylinder 7 an upper transfer cylinder 8 and a lower transfer cylinder 9, these two cylinders removing the now cross-folded copies from the surface 7.1 of the second copy-guiding cylinder 7.

Although in this case the guiding device 10 is assigned to the copy-guiding cylinders 6 and 7 of a pinless folder 1, the guiding device 10 may quite as well be assigned to the copy-guiding cylinders 6 and 7 of a folder with sets of pins.

Figure 2:
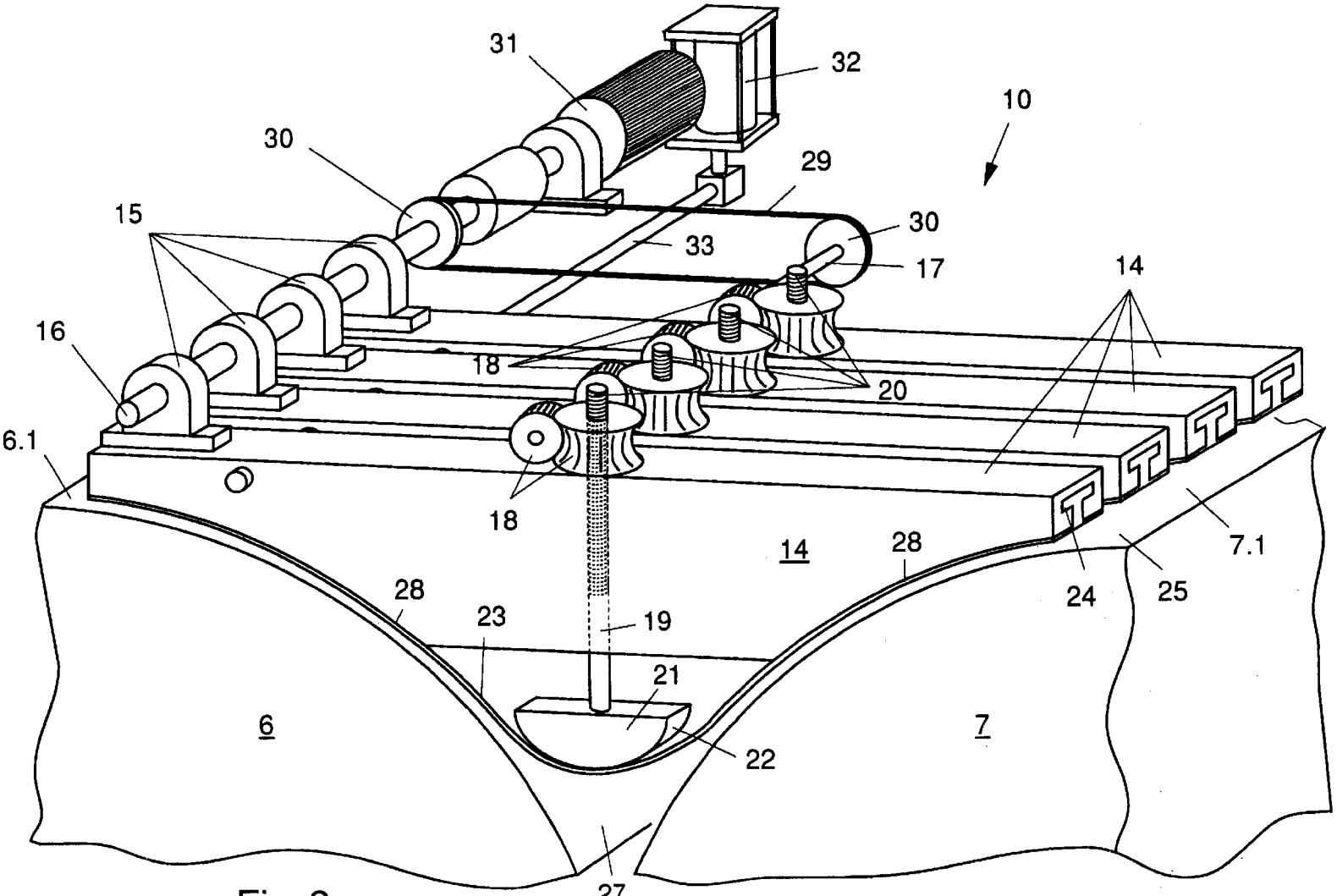
FIG. 2 is a fragmentary front, side and top perspective view of a guiding device according to the invention in the outlet wedge between the two cylinders.

FIG. 2 is a perspective view of a guiding device according to the invention in the outlet wedge between two copy-guiding cylinders.

The guiding device 10 that is disposed above an outlet wedge 27 between the surfaces 6.1 and 7.1 of two copy-guiding cylinders 6 and 7 includes a plurality of guide bodies 14. The guide bodies 14 each have a bearing 15 by which they are received on a pivot spindle 16 forming part of the guiding device assembly. Through the intermediary of the adjusting or adjusting cylinder 11 according to FIG. 1, or the adjusting or adjusting cylinder 32 shown in FIG. 2, the entire guiding device 10 can be pivoted out of the outlet wedge 27 between the copy-guiding cylinders 6 and 7 and moved back into the wedge 27 again.

Adjusting or adjusting spindles 20 extend through bores 19 formed in each of the guide bodies 14, and the adjusting spindles receive or hold, at the lower ends thereof, adjusting elements 21 similar to hammerheads but with a rounded outer contour 22. Provided in the upper section of the adjusting spindles 20 are adjusting wheels 18 through which the adjusting spindles 20, which are provided with an external thread, extend. The adjusting wheels 18 of the adjusting spindles 20, on their part, cooperate with adjusting wheels 18 which are mounted on a shaft 17. This shaft 17 is adjusted remotely via a drive element 29 that revolves about two pulleys or sprockets 30, driven by a drive 31, with the result that all of the adjusting elements 21 can be extended out of the guide bodies 14 or retracted into the latter. The drive element 29 may be a belt drive or a chain drive or the like. It would likewise be just as possible for the drive 31 to be provided directly on the adjusting shaft 17.

The guide bodies 14, respectively, are formed with a groove 24 that may be profiled in various ways. Extensions of a guiding material 23 which are shaped in accordance with the profiling of the groove 24 engage in the respective groove 24. The outer surface of the guiding material 23 is directed towards the copies, which pass the outlet wedge 27 formed between the surfaces 6.1 and 7.1 of the copy-guiding cylinders 6 and 7. The aforementioned retractably and extensibly arranged adjusting element 21 acts upon the rear side of the guiding material 23 and is connected to the latter approximately in the center of the guiding material 23. This makes it possible for the sections of the guiding material 23 to move in the respective groove 24 thereof relative to an abutment surface 28 of the guide bodies 14. Together with the suitable profiling of the guiding material 23, the groove 24 thus causes the guiding material to be arrested at 25 in the guide bodies 14, but allows the guiding said material to move relative to the arcuate abutment surfaces 28 of the guide bodies 14.

With respect to the cooperating adjusting wheels 18, which are illustrated only diagrammatically in FIG. 2, it should also be noted that these wheels 18 may be worm wheels, cylindrical wheels or else helically toothed or similar transmission elements. A worm drive would have the advantage of self-locking, with the result that there would be no unintended adjustments of the adjusting spindles 20, and thus of the adjusting elements 21, during operation.

Figure 3:
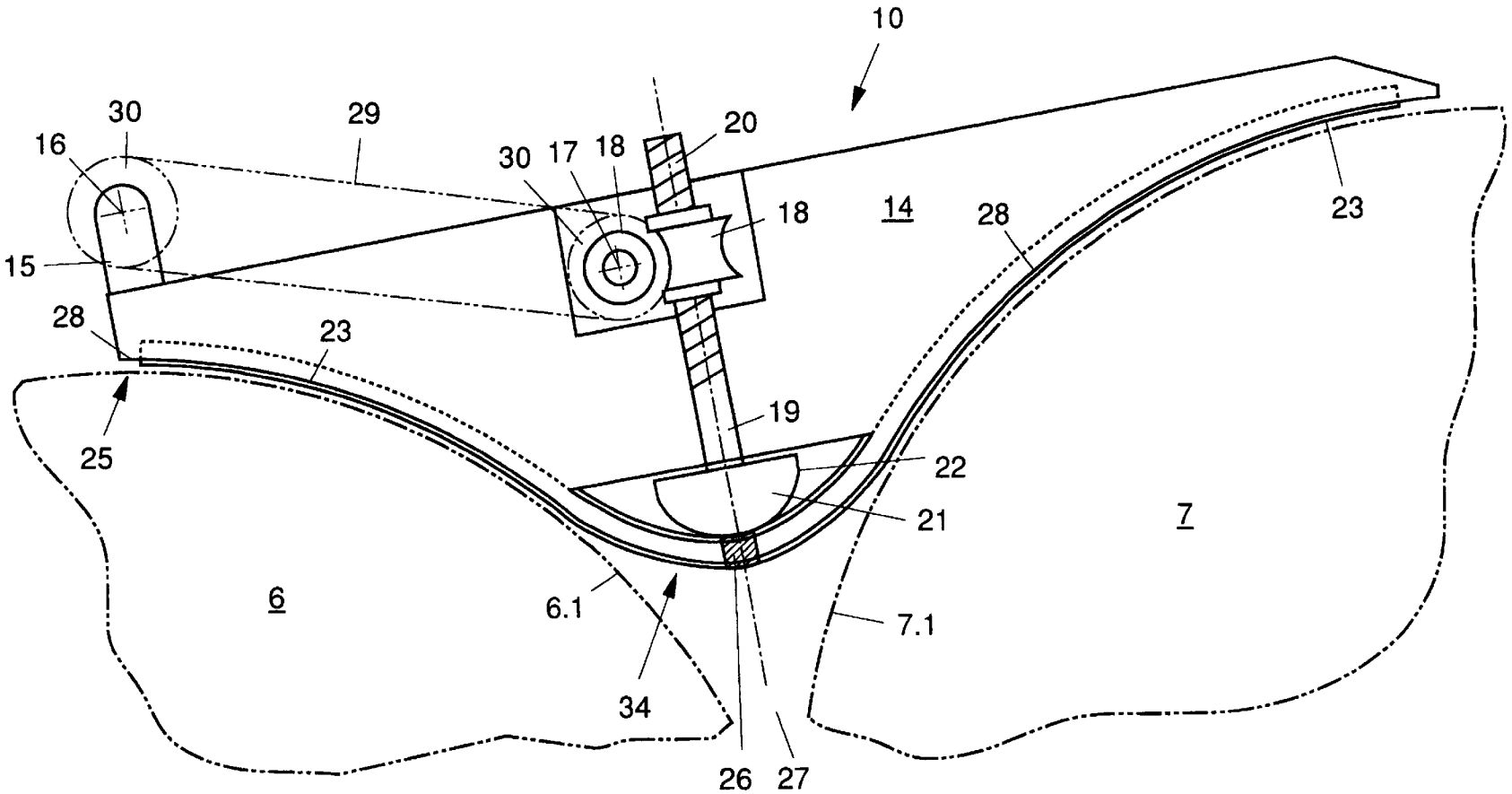
FIG. 3 is a side elevational view of FIG. 2 showing the guiding device partly retracted into the outlet wedge between the copy-guiding cylinders.

FIG. 3 is a side elevational view of the copy-guiding device according to the invention that has been partly retracted from the outlet wedge between the two copy-guiding cylinders 6 and 7.

In this illustration, the deflecting or return wheel 30 that is assigned to the adjusting shaft 17 is disposed in a plane that is different from the plane wherein the deflecting wheel 30 is located, the latter being mounted on the swivel or pivot spindle 16, at the bearing side. The drive element 29 thus assumes an inclined position. In the position shown in FIG. 3, the upper end of the adjusting spindle 20 remains projecting beyond the upper end of the guide bodies 14; accordingly, the adjusting element 21 has not been extended to a maximum extent into the outlet wedge 27 between the surfaces 6.1 and 7.1 of the copy-guiding cylinders 6 and 7. Provided on the adjusting element 21, which has a rounded outer contour 22, is a fastener 26 by which the guiding material 23 is fixed in the center thereof both relative to the outlet wedge 27 and to the adjusting element 21.

The fastener or fastening element 26 is set back by the head thereof, behind the guiding material 23, and does not project into the conveying path of the copy along the guiding device 10. The guiding material 23, which is arranged in strip form on the guide body 14, may move relative to the abutment surface 28 in the respective guide thereof when the adjusting element 21 is extended out of the guide body 14. In the condition or operating phase shown in FIG. 3, the rounded portion 22 of the adjusting element 21 abuts the guiding material 23 only in the region of the fastener 26 because the adjusting element 21 remains virtually entirely retracted into the guide body 14 thereof. The guiding material 23 is an elastic ink-repellent material that is provided with a smooth surface and is assigned to the curved surfaces 6.1 and 7.1 of the copy-guiding cylinders 6 and 7, respectively, so that a gap of approximately 0.5 to 1 cm forms thereat. When the adjusting element 21 is extended out of the guide body 14, there is no change in this gap between the cylinder surface and the guiding material 23; only the geometry of the outlet wedge 27 between the cylinders 6 and 7 changes. In the "large-radius" position 34 shown in FIG. 3, the outlet wedge 27 is covered over from above, as it were, by the guiding material 23, by which the copies are transported through the outlet wedge 27 without the edges of the copies being able to fold over due to the whiplash effect that occurs when the conveying direction of the copies is reversed.

Figure 4:
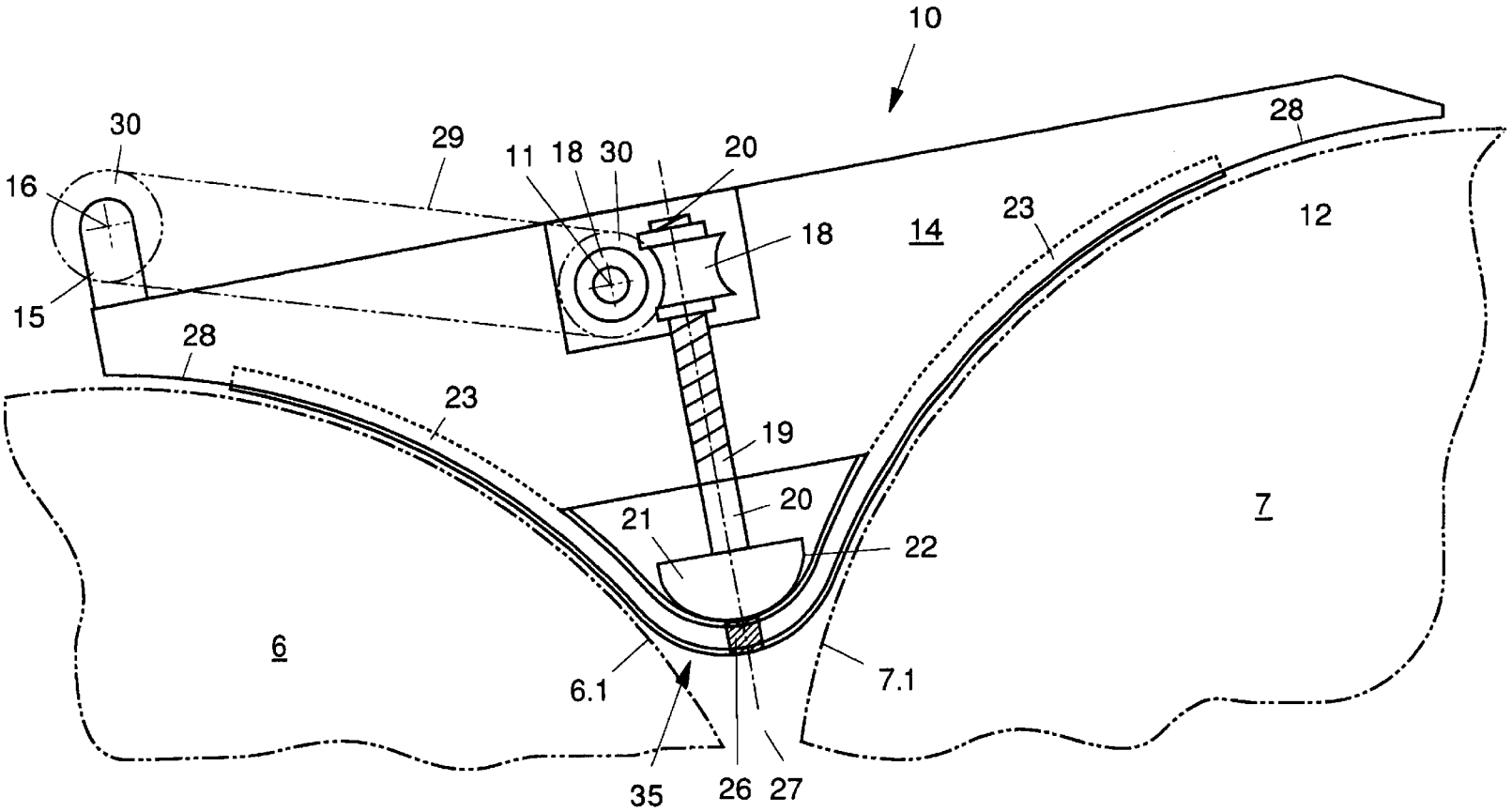
FIG. 4 is another side elevational view of the guiding device like that of FIG. 3, with an adjusting element thereof retracted to a maximum extent into the outlet wedge between the cylinders.

FIG. 4 is a side elevational view of the guiding device 10 with the adjusting element 21 retracted to a maximum extent into the outlet wedge 27 between the cylinders 6 and 7.

FIG. 4 shows the adjusting element 21 in a position 35, in which it has been extended out of the basic guide body 14. Through the intermediary of the drive element 29, the adjusting spindle 20, driven via the adjusting wheels 18, is moved into an extended position wherein the adjusting element 21 forces the guiding material 23 into the outlet wedge 27. The guiding material 23 fits closely or snugly against the rounded outer contour 22 of the adjusting element 21 and moves along the abutment surface 28. In comparison with FIG. 3, the guiding material 23, in the condition or operating phase shown in FIG. 4, is farther away from the ends of the basic guide body 14. The lengthening of that region of the guiding material 23 which has travelled into the outlet wedge 27 means that the guiding material 23 has moved in the guide 24 thereof that permits movement relative to the abutment surface 28, without any occurrence of a change in the gap width between the cylinder surfaces 6.1 and 7.1, on the one hand, and the surface of the guiding material 23, on the other hand.

According to the aforedescribed configuration of the guiding device 10, it is possible for the geometry of the outlet wedge 27 to be taken into account for different folding-copy thicknesses and printing-material thicknesses, and so forth, by remote adjustment, even in the case of machine presetting.

We claim:

1. A guiding device for copies in a folder of a rotary printing machine, comprising:

a guiding material engageable with copies projecting into an outlet wedge formed between copy-guiding cylinders, said guiding material forming a surface facing towards the copies, said surface having a geometry being variable, changeable and adjustable;

a guide body having a curved and fixed geometry for contacting and guiding said guiding material along the fixed and curved geometry of said guide body, said guide body allowing said guiding material to move relative to the fixed and curved geometry of said guide body; and an adjusting element extensible and retractable out of said guide body for changing and adjusting the geometry of said guiding material, said adjusting element having a rounded outer contour for contacting and guiding said guiding material, and said adjusting element allowing said guiding material to move relative to said adjusting element.

2. A guiding device assembly according to claim 1, further comprising a shaft about which the guiding device is swivellable.

3. The guiding device assembly according to claim 2, further comprising an adjusting cylinder for swivelling the guiding device.

4. The guiding device according to claim 1, wherein said guide body has a structure for holding said guiding material.

5. The guiding device according to claim 1, further comprising a guiding element arranged in strip form on said guide body.

6. The guiding device according to claim 1, wherein said guiding material is movable relative to an abutment surface formed on said at least one guide body.

7. The guiding device according to claim 1, including a plurality of said guide bodies, and a common drive for actuating the adjusting elements of said guide bodies.

8. The guiding device according to claim 7, wherein said adjusting elements are adjustable by said drive relative to said guide bodies.

9. The guiding device according to claim 1, including a plurality of said guide bodies arranged side by side so that they extend over the width of the copy-guiding cylinders.

10. The guiding device according to claim 1, including a fastener for fastening said guiding material on said adjusting element, and wherein said fastener is set back behind a surface of said guiding material that faces towards the copies.

11. A guiding device for copies in a folder of a rotary printing machine, comprising:

a guiding material engageable with copies projecting into an outlet wedge formed between copy-guiding cylinders, said guiding material forming a surface facing towards the copies and having a first section and a second section;

a guide body having a curved and fixed geometry for contacting and guiding said first section of said guiding material along the fixed and curved geometry of said guide body, said guide body allowing said guiding material to move relative to the fixed and curved geometry of said guide body; and an adjusting element contacting said second section of said guiding material and having a geometry, said adjusting element being extensible and retractable for changing and adjusting said geometry of said adjusting element, said adjusting element having a rounded outer contour for contacting and guiding said second section of said guiding material, and said adjusting element allowing said guiding material to move relative to said adjusting element.

12. The guiding device according to claim 11, wherein said adjusting element contacts said guiding material approximately in a center of said outlet wedge.

13. The guiding device according to claim 11, wherein said guiding material is a smooth elastic ink-repellent material.

14. The guiding device according to claim 11, wherein said curved and fixed geometry of said guide body corresponds to shapes of said copy-guiding cylinders.

15. The guiding device according to claim 11, wherein said adjusting element is adjusted such that copies are transported through the outlet wedge without copies being able to fold over due to a whiplash effect occurring upon a conveying direction of the copies being reversed.

16. The guiding device according to claim 11, wherein said guide body is one of a plurality of guide bodies.

17. The guiding device according to claim 11, wherein said guiding device is swivellable relative to the outlet wedge formed between the copy-guiding cylinders.

18. The guiding device assembly according to claim 17, further comprising a shaft about which the guiding device is swivellable.

19. The guiding device assembly according to claim 17, further comprising an adjusting cylinder for swivelling the guiding device.

20. The guiding device according to claim 11, wherein said guide body has a structure for holding said guiding material.

21. The guiding device according to claim 11, further comprising a guiding element disposed in strip form on said guide body.

22. The guiding device according to claim 11, wherein said guiding material is movable relative to an abutment surface formed on said guide body.

23. In combination with copy-guiding cylinders for copies in a folder of a rotary printing machine, the guiding device according to claim 11.

24. In combination with a folder with copy-guiding cylinders, the guiding device according to claim 11.

* * * * *